US006976462B2

(12) United States Patent
Jesel

(10) Patent No.: US 6,976,462 B2
(45) Date of Patent: Dec. 20, 2005

(54) DOUBLE ROLLER CAM FOLLOWER

(75) Inventor: Daniel H. Jesel, Lakewood, NJ (US)

(73) Assignee: Jesel, Inc., Lakewood, NJ (US)

( * ) Notice: Subject to any disclaimer, the term of this patent is extended or adjusted under 35 U.S.C. 154(b) by 0 days.

(21) Appl. No.: 10/956,332

(22) Filed: Oct. 4, 2004

(65) Prior Publication Data

US 2005/0183683 A1 Aug. 25, 2005

Related U.S. Application Data

(60) Provisional application No. 60/507,528, filed on Oct. 2, 2003.

(51) Int. Cl.[7] ..... F01L 1/18

(52) U.S. Cl. ..... 123/90.44; 123/90.39; 123/90.41; 123/90.43; 123/90.45; 123/90.2; 123/90.27; 123/90.31; 74/569; 74/519; 74/559; 384/58; 384/548; 384/549

(58) Field of Search ..... 123/90.44, 90.2, 123/90.27; 74/569

(56) References Cited

U.S. PATENT DOCUMENTS 5,060,606 A * 10/1991 Hubbard ..... 123/90.39
5,074,261 A * 12/1991 Hamburg et al. ..... 123/90.39
5,596,958 A * 1/1997 Miller ..... 123/90.23

* cited by examiner

*Primary Examiner*—Thomas Denion
*Assistant Examiner*—Kyle M. Riddle
(74) *Attorney, Agent, or Firm*—Harbin King & Klima

(57) ABSTRACT

A double roller cam follower includes a longitudinal beam having a first end and a second end, a cam roller rotationally mounted on the beam for engaging a cam lobe and a valve stem roller rotationally mounted on the second end of the beam for engaging a valve stem. The cam roller includes a stepped outer circumference having a larger diameter at its sides to engage the cam lobe and a smaller diameter positioned centrally between the flanking larger diameters to provide clearance between the cam roller and the valve stem roller.

23 Claims, 6 Drawing Sheets

DOUBLE ROLLER CAM FOLLOWER

This application claims priority to U.S. Provisional Patent Application No. 60/507,528, filed Oct. 2, 2003, entitled "Double Roller Cam Follower", the entirety of which is incorporated by reference herein.

FIELD OF THE INVENTION

The present invention relates to a cam follower which is positioned between a camshaft and a valve in an overhead cam engine, and particularly, to a roller cam follower.

BACKGROUND OF THE INVENTION

In certain known types of overhead cam engines, the lobes of the camshaft directly contact the respective valves to actuate the valves. In other known types of overhead cam engines, the lobes of the cam do not directly contact the valves for valve actuation. Rather, a cam follower is positioned between the cam lobe and the valve stem and the cam lobe actuates the cam follower which, in turn, actuates the valve.

In a specific type of such an engine, such as a General Motors Northstar®, High Value V6® or Ecotech® engine, as shown in FIG. 1 (Prior Art), the cam follower 10 has a longitudinal beam 12 having a first end 14 and a second end 16. The first end 14 rests on a static hydraulic lash adjuster 18 via seat 68 on the beam 12 and the second end 16 bears on the valve stem 20 to actuate the valve 22. A cam roller 24 having an axis of rotation 26 perpendicular to a longitudinal plane of the follower beam 12 is rotationally mounted on the beam 12 between the first end 14 and the second end 16 to contact and provide a low friction engagement with the cam lobe 28 of camshaft 30. Thus, the cam lobe 28 rotates against the follower cam roller 24, thereby moving the cam roller 24 and cam follower 10 in a direction of actuation. Since the first end 14 of the follower beam 12 rests on the static hydraulic lash adjuster 18 via seat 68, the movement of the cam lobe 28 and cam roller 24 is transmitted to the valve stem 20. The second end 16 of the follower beam 12 includes generally a polished curved surface 36 (see FIG. 8) that engages the valve stem 20 to actuate the valve 22. This is a relatively high friction engagement, especially with the forces resulting from actuating the valve 22 against the force of the valve spring 34. Fingers 70 (see FIGS. 1, 7 and 8) maintain alignment of the follower 10 with the valve stem 20.

It is known to also provide valve stem rollers on overhead valve engine rocker arms to provide a low friction engagement between the rocker arm and the valve stem. However, in the typical roller cam follower 10 discussed above, which is generally significantly smaller than a counterpart rocker arm, the geometry and dimensions of the roller cam follower 10 prevent use of a valve stem roller at the second end 16 of the follower beam 12 for engaging the valve stem 20 because the follower beam 12 has insufficient length to correctly position a valve stem roller of a proper diameter over the valve stem 20 while avoiding interference between the valve stem roller and the cam roller 24.

It is therefore an object of the present invention to provide a roller cam follower that includes both a cam roller and a valve stem roller.

It is a further object of the present invention to provide a roller cam follower that reduces friction in the valve train as compared to conventional roller cam followers.

It is a further object of the present invention to provide a roller cam follower that includes both a cam roller and a valve stem roller within the same length as allowed by a conventional follower beam.

Other objects of the present invention will be apparent from the description below.

SUMMARY OF THE INVENTION

The present invention is a double roller cam follower that includes a longitudinal beam having a first end and a second end, a cam roller rotationally mounted on the beam for engaging a cam lobe and a valve stem roller rotationally mounted on the second end of the beam for engaging a valve stem. The cam roller includes a stepped outer circumference having a larger diameter at its sides to engage the cam lobe and a smaller diameter positioned centrally between the flanking larger diameters to provide clearance between the cam roller and the valve stem roller.

DETAILED DESCRIPTION OF THE INVENTION

Figure 4:
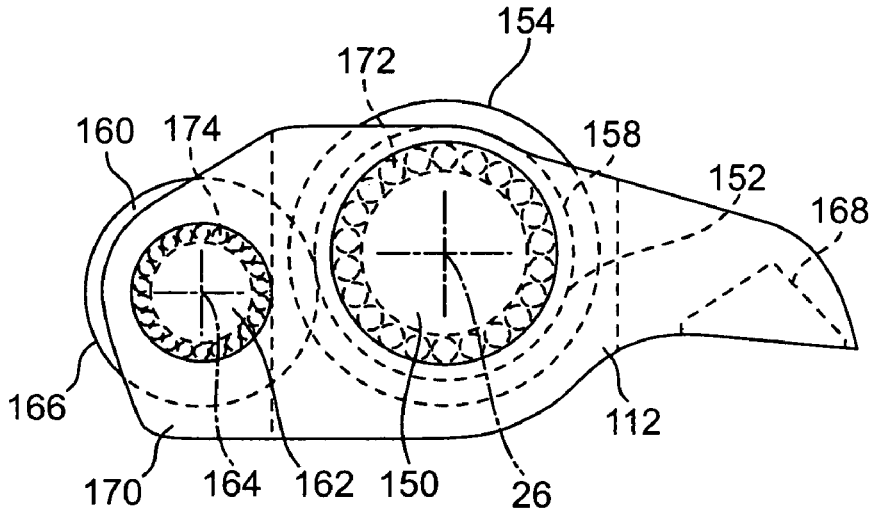
FIG. 4 is a side schematic view of the double roller cam follower of FIG. 2.
Figure 5:
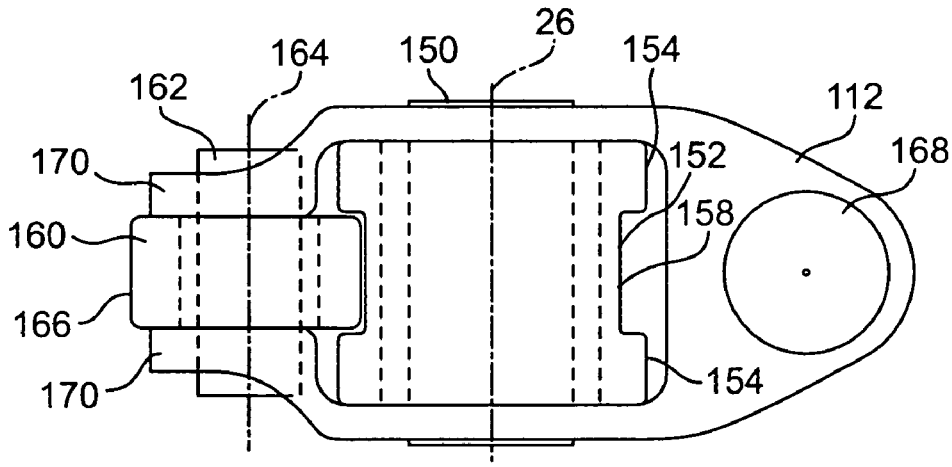
FIG. 5 is a bottom schematic view of the double roller cam follower of FIG. 2.

A double roller cam follower 110 includes a longitudinal beam 112 having a first end 114 and a second end 116. See FIGS. 2–7. A cam roller 124 is rotationally mounted on a roller axle 150 mounted to the longitudinal beam 112 transversely to a longitudinal plane of the beam 112 to provide the cam roller 124 an axis of rotation 26. The cam roller 124 is preferably rotationally mounted on the roller axle 150 with roller bearings 172, in this case shown as needle bearings (see FIG. 4), although other types of bearings or bushings can also be used or the cam roller 124 can be mounted directly on the roller axle 150.

The cam roller 124 includes a stepped outer surface 152 having larger diameter portions 154 at its outer sides and a smaller diameter portion 158 positioned centrally on the cam roller 124 between the flanking larger diameter portions 154. The diameter of the larger diameter portions 154 is preferably set the same as the diameter of a conventional cam follower 24 so that the geometry between the components is maintained, although the dimensions can be changed if desired.

A valve stem roller 160 is rotationally mounted on a roller axle 162 mounted to the longitudinal beam 112 transversely to the longitudinal plane of the beam 112 to provide the valve stem roller 160 an axis of rotation 164 that is parallel with the axis of rotation 26. The valve stem roller 160 is preferably rotationally mounted on the roller axle 162 with roller bearings 174, in this case shown as needle bearings (see FIG. 4), although other types of bearings or bushings can also be used or the valve stem roller 160 can be mounted directly on the roller axle 162. The valve stem roller 160 has an outer diameter 166.

The smaller diameter portion 158 of the stepped outer surface 152 of the cam roller 124 provides clearance between the cam roller 124 and the valve stem roller 160. The diameter of the smaller diameter portion 158 is set to accommodate the diameter 166 of the valve stem roller 160 with the desired clearance between the two components, while still providing sufficient diameter to house any bearing or bushing in the cam roller 124. Alternatively, two separate bearings or bushings can be mounted only in the larger diameter portions 154 of the cam roller 124 so that the minimum diameter of the smaller diameter portion 158 is not constrained by such bearings or bushings but only by the diameter of the cam roller axle 150.

At one extreme end of the invention, the two larger diameter portions 154 can be separate components without an intermediate smaller diameter portion 158 so that the diameter of the valve stem roller 160 is only constrained by the diameter of the cam roller axle 150, which may itself be stepped or notched to provide additional clearance. In such an embodiment, the larger diameter portions 154 would be laterally constrained by a separate component, such as an extension of the beam 12, another roller mounted toward the first end, steps on the axle 150, etc. The width of the smaller diameter portion 158 is also set to accommodate the width of the valve stem roller 160 with the desired clearance between the two components. The shape and dimensions of the stepped outer surface 152 can be altered as desired.

To summarize in a different manner, the distance between the axis 26 and the axis 164 is less than the sum of one half of the outer diameter 166 and one half of the diameter of the larger diameter portions 154, or stated differently, the sum of the outer diameter 166 and the diameter of the larger diameter portions 154 is more than twice the distance between the axis 26 and the axis 164.

For example, given dimensions for a typical application (though not to be limited to such dimensions), the diameter of larger diameter portions 154 of cam roller 124 is 0.700 inch, the diameter of smaller diameter portion 158 is 0.580 inch and the outer diameter 166 of valve stem roller 160 is 0.520 inch. The distance between axis 26 and axis 164 is 0.557 inch. Thus, the distance between the axis 26 and the axis 164 (0.557 inch) is less than the sum of one half of the outer diameter 166 and one half of the diameter of the larger diameter portions 154 ($0.5\times(0.520+0.700)=0.5\times(1.220)=0.610$ inch). In fact, using the given dimensions, the distance between the axis 26 and the axis 164 is approximately only 91% of the sum of one half of the outer diameter 166 and one half of the diameter of the larger diameter portions 154 (0.557/0.610=91.31%). This percentage can theoretically be in the range of greater than 50% and less than 100% but in practice is set in a smaller range, preferably in the range of 75–99%.

Stated differently, the sum of the outer diameter 166 and the diameter of the larger diameter portions 154 (0.520+0.0700=1.220 inch) is more than twice the distance between the axis 26 and the axis 164 ($2\times0.557=1.114$ inch). In fact, using the given dimensions, the sum of the outer diameter 166 and the diameter of the larger diameter portions 154 is approximately 219% the distance between the axis 26 and the axis 164 (1.220/0.557=219%). This percentage can theoretically be in the range of greater than 200% and less than 400% but in practice is set in a smaller range, preferably in the range of 201–300%.

The ratio of the diameters of the smaller diameter portion 158 to the larger diameter portions 154, given the above dimensions, is approximately 82.9%. While this percentage can theoretically be in the range of greater than 0% and less than 100%, in practice it is set in a smaller range, preferably in the range of 50% to 99%.

The present invention can be set within any specific range falling within, inclusively, the above given ranges.

With this construction, the diameters of the valve stem roller 160 and the larger diameter portions 154 of the cam roller 124 can be set as desired for proper operation of the follower 110 without the sum of such diameters having to be less than twice the distance between the axis 26 and the axis 164. Otherwise, the rollers would have to be made too small to operate properly and to bear the loads that they will experience. Although the contact area between the cam roller 124 and the cam lobe 28 is reduced by the present invention, it is still maintained within appropriate parameters to bear the loads experienced in the system.

The double roller cam follower 110 also includes a seat 168 positioned on the longitudinal beam 112 for engaging the static hydraulic lash adjuster 18. See FIGS. 4–6 and 8. The axles 150 and 162 are mounted to the beam 112 in a known manner, such as by a staking process or by use of retainers, etc. The double roller cam follower 110 also include fingers 170 positioned on the second end 116 and extending downward to straddle a portion of the valve stem 20 to maintain lateral positioning of the follower 110 with respect to the cam lobe 28 and valve stem 20. See FIGS. 4–8.

Figure 7:
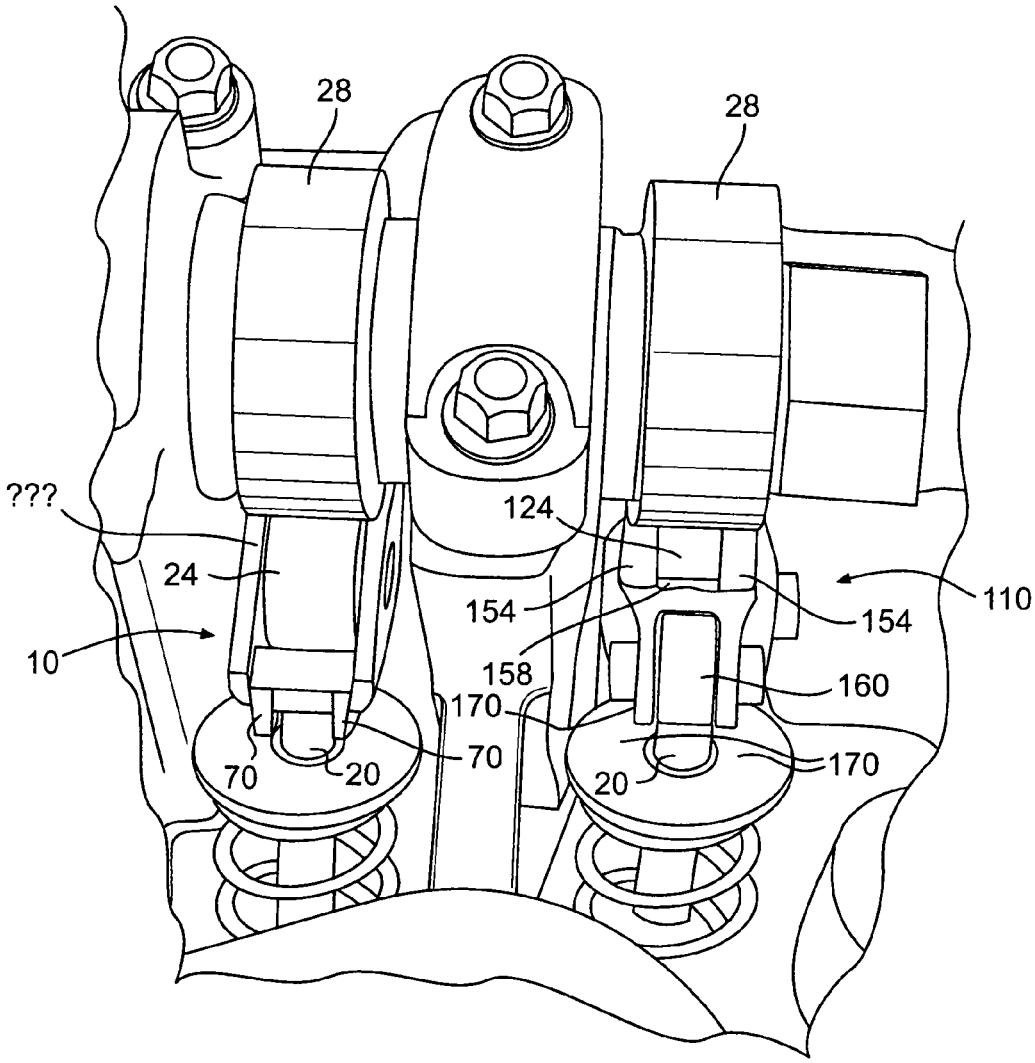
FIG. 7 is a perspective view from a valve side comparing the double roller cam follower of the present invention (on the right) with a conventional roller cam follower (on the left), both mounted on an engine.
Figure 8:
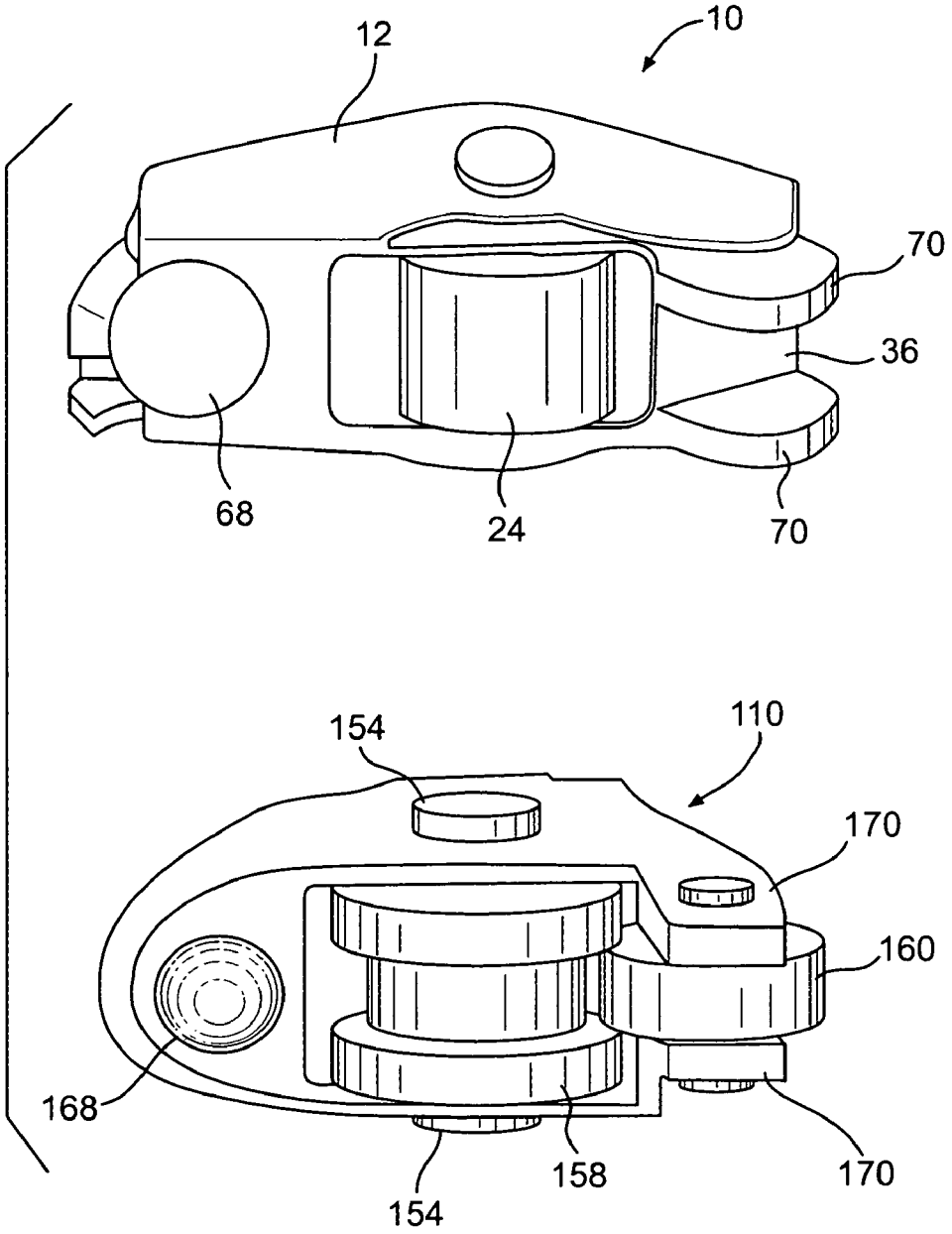
FIG. 8 is a bottom perspective view comparing the double roller cam follower of the present invention (on the bottom) with a conventional roller cam follower (on the top).

FIG. 7 is a perspective view comparing the double roller cam follower 110 of the present invention with a conventional roller cam follower 10. The double roller cam follower 110 is on the right in FIG. 7. As can be seen in FIG. 7, the cam roller 124 of the present invention is preferably wider than the cam roller 24 of the prior art. This allows for a greater width of the smaller diameter portion to accommodate a wider valve stem roller 160. The wider cam roller 124 does not create problems in engaging the cam lobe 28, since, as seen in FIG. 8, the cam lobe 28 is actually wider than the prior art cam roller 24. Preferably, the valve stem roller 160 is as wide as the valve stem 20, though this need not be the case. In an alternative embodiment, the cam roller 124 can have only one larger diameter portion 154 for engaging the cam lobe, with the one larger diameter portion being offset to one side of the valve stem roller 160, although this is not currently preferred because of the tilting forces that will be applied to the cam follower. In such an embodiment, the tilting forces can be accommodated by further structure supporting the cam follower.

Figure 1:
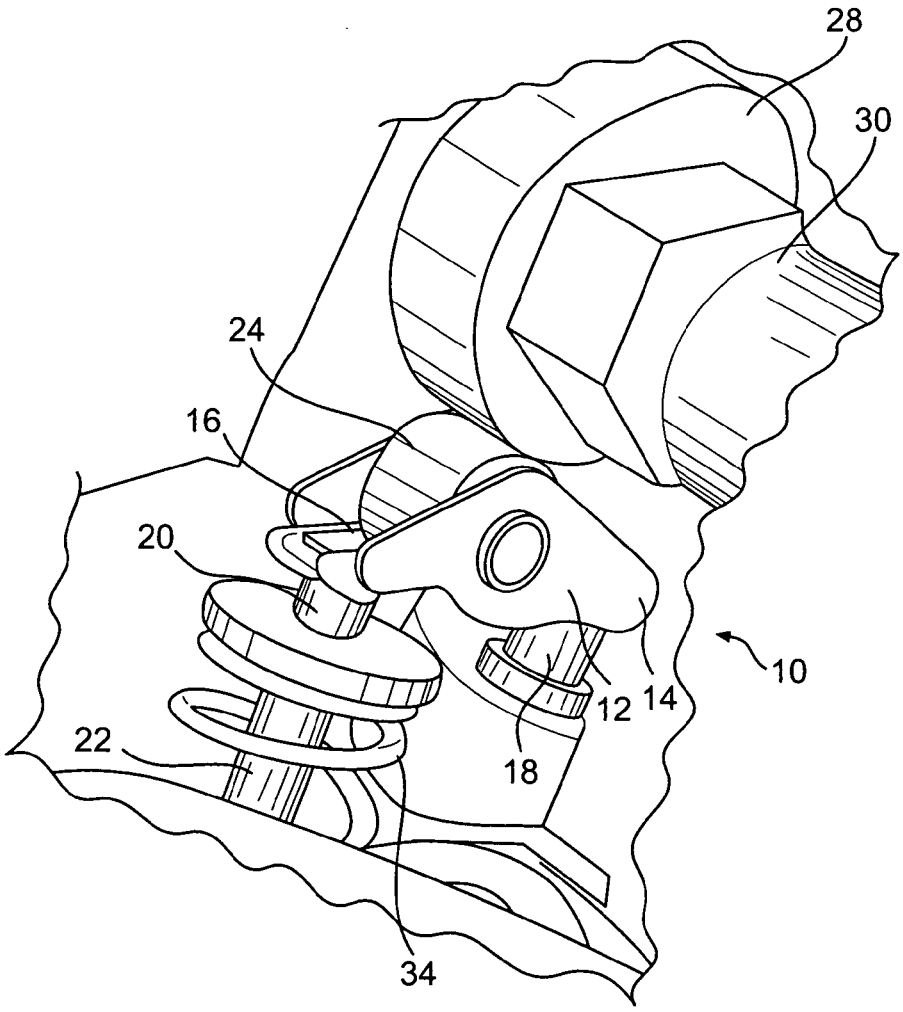
FIG. 1 PRIOR ART
FIG. 1 (Prior Art) is a perspective view of a conventional roller cam follower mounted on an engine.
Figure 2:
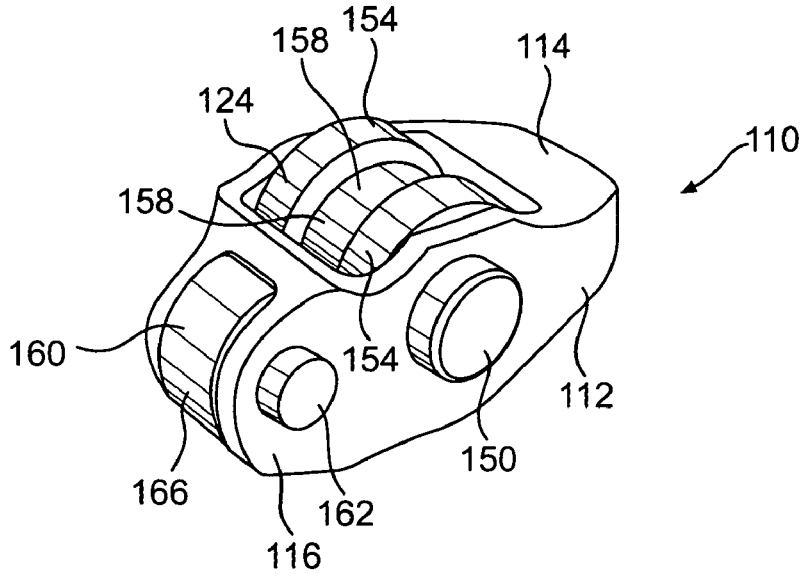
FIG. 2 is a top perspective view of a double roller cam follower of the present invention.
Figure 3:
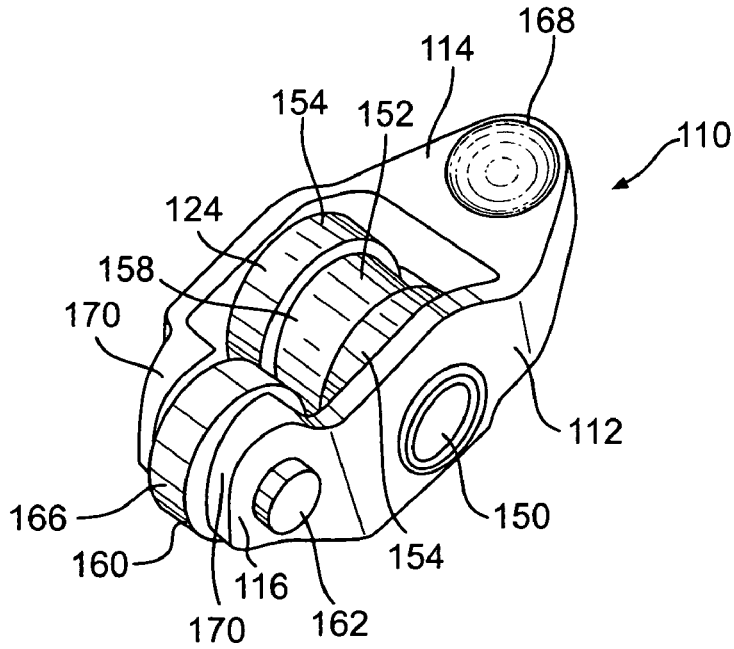
FIG. 3 is a bottom perspective view of the double roller cam follower of FIG. 2.
Figure 6:
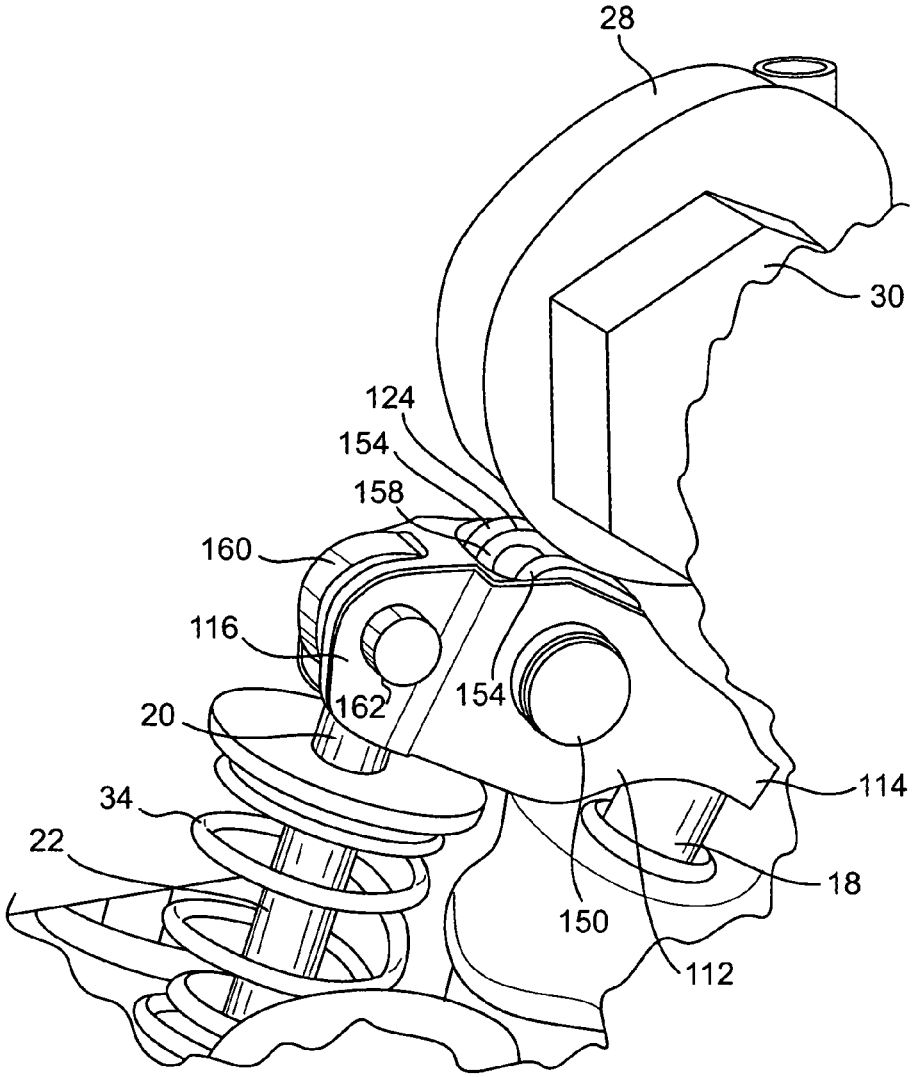
FIG. 6 is a side perspective view of the double roller cam follower of FIG. 2 mounted on an engine.

FIG. 8 is a perspective view comparing the double roller cam follower of the present invention on the bottom with a conventional roller cam follower on the top. Portions of the cylinder head assembly to which the present invention cam operated mechanism is mounted are shown in FIGS. 1, 6 and 7.

In an alternative embodiment, the engagement between the cam follower 110 and lash adjuster 118 can be via an axle and bearing arrangement, similar to what is used to mount the rollers to the cam follower.

In a preferred embodiment, the longitudinal beam 112 is machined from a solid piece of metal, usually steel or aluminum, but can also be made with different methods and materials. The follower 110 can be configured and altered as desired to be used in different models of engines. Likewise, the present invention can be applied to other components, including but not limited to rocker arms, where a double roller system is desired but space for two appropriately sized rollers is limited. In such a situation, one of the rollers may be for the pivoting of the rocker arm, as opposed to engaging the camshaft but the same principles as discussed above would otherwise apply to the double roller mechanism. The different features described herein can be combined in various manners to create new embodiments.

What is claimed is:

1. A cam operated mechanism, comprising:

a longitudinal beam having a first end and a second end;

a cam roller rotationally mounted on the beam for engaging a cam lobe, the cam roller including an outer circumference having at least one larger diameter portion for engaging the cam lobe;

a valve stem roller rotationally mounted on the second end of the beam and having an outer circumference portion for engaging a valve stem to actuate the valve stem;

wherein, a distance between an axis of the cam roller and an axis of the valve stem roller is less than the sum of one half of a diameter of the cam roller larger diameter portion and one half of a diameter of the valve stem roller outer circumference portion.

2. A cam operated mechanism as in claim 1, wherein the cam roller includes a stepped outer circumference having the at least one larger diameter portion and at least one smaller diameter portion, the smaller diameter portion providing a clearance between the cam roller and the valve stem roller.

3. A cam operated mechanism as in claim 2, wherein the cam roller includes two larger diameter portions flanking the smaller diameter portion which is positioned between the two larger diameter portions, with the outer circumference portion of the valve stem roller being positioned adjacent the smaller diameter portion and between the two larger diameter portions.

4. A cam operated mechanism as in claim 3, wherein the cam roller is rotationally mounted on at least one axle mounted to the longitudinal beam and the valve stem roller is rotationally mounted on at least one axle mounted to the longitudinal beam.

5. A cam operated mechanism as in claim 4, wherein the cam operated mechanism is a cam follower.

6. A cam operated mechanism as in claim 5, and including a cylinder head assembly, with the cam follower and valve stem being mounted to the cylinder head.

7. A cam operated mechanism as in claim 4, wherein the cam operated mechanism is a rocker arm.

8. A cam operated mechanism as in claim 7, and including a cylinder head assembly, with the rocker arm and valve stem being mounted to the cylinder head.

9. A cam operated mechanism as in claim 1, wherein the cam operated mechanism is a rocker arm.

10. A cam operated mechanism as in claim 1, wherein the cam roller includes two separate larger diameter portions, with the outer circumference portion of the valve stem roller being positioned between the two larger diameter portions.

11. A cam operated mechanism as in claim 4, wherein the at least one cam roller axle is notched to provide additional clearance for the valve stem roller.

12. A cam operated mechanism as in claim 5, wherein the first end of the longitudinal beam includes a portion for engaging a lash adjustment mechanism.

13. A cam operated mechanism as in claim 5, wherein the distance between the cam roller axis and the valve stem axis is in the range of 75–99% of the sum of one half of the diameter of the cam roller larger diameter portion and one half of the diameter of the valve stem roller outer circumference portion.

14. A cam operated mechanism as in claim 13, wherein the distance between the cam roller axis and the valve stem axis is in the range of 90–93% of the sum of one halt of the diameter of the cam roller larger diameter portion and one half of the diameter of the valve stem roller outer circumference portion.

15. A cam operated mechanism as in claim 1, wherein the distance between the cam roller axis and the valve stem axis is in the range of 75–99% of the sum of one half of the diameter of the cam roller larger diameter portion and one half of the diameter of the valve stem roller outer circumference portion.

16. A cam operated mechanism as in claim 15, wherein the distance between the cam roller axis and the valve stem axis is in the range of 90–93% of the sum of one half of the diameter of the cam roller larger diameter portion and one half of the diameter of the valve stem roller outer circumference portion.

17. A cam operated mechanism as in claim 1, wherein the first end of the longitudinal beam includes a portion for engaging a lash adjustment mechanism.

18. A cam operated mechanism, comprising:

a longitudinal beam having a first end and a second end, the first end including a portion for engaging a generally static support mechanism;

a cam roller axle mounted on the longitudinal beam;

a cam roller rotationally mounted on cam roller axle the beam for engaging a cam lobe, the cam roller including a stepped outer circumference having two larger diameter portions flanking a smaller diameter portion positioned between the two larger diameter portions, the larger diameter portions for engaging the cam lobe;

a valve stem roller axle mounted on the second end of the beam;

a valve stem roller rotationally mounted on the valve stem roller axle and having an outer circumference portion for engaging a valve stem to actuate the valve stem, the outer circumference portion of the valve stem roller being positioned adjacent the smaller diameter portion and between the two larger diameter portions, with a clearance being provided between the smaller diameter portion and the adjacent outer circumference portion of the valve stem roller;

wherein, a distance between an axis of the cam roller and an axis of the valve stem roller is less than the sum of one half of a diameter of the cam roller larger diameter portion and one half of a diameter of the valve stem roller outer circumference portion.

19. A cam operated mechanism as in claim 18, wherein the cam operated mechanism is a cam follower.

20. A cam operated mechanism as in claim 19, and including a cylinder head assembly, with the cam follower and valve stem being mounted to the cylinder head.

21. A cam operated mechanism as in claim 20, wherein the distance between the cam roller axis and the valve stem axis is in the range of 75–99% of the sum of one half of the diameter of the cam roller larger diameter portion and one half of the diameter of the valve stem roller outer circumference portion.

22. A cam operated mechanism as in claim 21, wherein the distance between the cam roller axis and the valve stem axis is in the range of 90–93% of the sum of one half of the diameter of the cam roller larger diameter portion and one half of the diameter of the valve stem roller outer circumference portion.

23. A cam operated mechanism as in claim 18, and including a cylinder head assembly, with the cam follower and valve stem being mounted to the cylinder head.

* * * * *